US005956767A

United States Patent [19]

Imm

[11] Patent Number: 5,956,767

[45] **Date of Patent: *Sep. 28, 1999**

[54] INFANT COVER-UP

[75] Inventor: Mary E. Imm, Cincinnati, Ohio

[73] Assignee: Noel Joanna, Inc., Rancho Santa Margarita, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,245

[22] Filed: Jun. 25, 1997

Related U.S. Application Data

[63] Continuation of application No. 08/611,919, Mar. 6, 1996, abandoned.

[51] Int. Cl.[6] ..... A41B 1/12; A41D 1/12

[52] U.S. Cl. ..... 2/69.5; 2/69

[58] Field of Search ..... 297/487, 254, 297/255, 274, 275, 184.13, 184.14, 219.12, 228.11, 256.15; 2/69, 87, 88, 89, 97, 69.5

[56] References Cited

U.S. PATENT DOCUMENTS

| | | |
|---|---|---|
| D. 120,718 | 5/1940 | Friedman . |
| D. 127,524 | 5/1941 | Segerman . |
| D. 267,284 | 12/1982 | Andrews . |
| 569,521 | 10/1896 | Scatchard . |
| 965,921 | 8/1910 | Mercey . |
| 1,264,971 | 5/1918 | Pickles . |
| 1,373,378 | 3/1921 | Backman . |
| 1,940,224 | 12/1933 | Munro . |
| 2,008,919 | 7/1935 | Milkes . |
| 2,227,751 | 1/1941 | Idelman . |
| 2,324,665 | 7/1943 | Ayres . |
| 2,441,745 | 5/1948 | Benamy . |
| 2,504,761 | 4/1950 | Turco . |
| 2,537,537 | 1/1951 | Ljungberg . |
| 2,888,009 | 5/1959 | Taylor . |
| 3,787,906 | 1/1974 | Hunt . |
| 3,831,206 | 8/1974 | Geary . |
| 4,311,339 | 1/1982 | Heath . |
| 4,587,671 | 5/1986 | Rodriquez, Jr. et al. . |
| 4,616,365 | 10/1986 | Lyons . |
| 4,674,800 | 6/1987 | Ensign . |
| 4,823,405 | 4/1989 | Porter . |
| 4,946,221 | 8/1990 | Livingston . |
| 4,989,282 | 2/1991 | Goldstein . |
| 4,993,090 | 2/1991 | Ranalli . |
| 4,997,231 | 3/1991 | Smith . |
| 5,046,204 | 9/1991 | Mohler . |
| 5,168,579 | 12/1992 | Marshall . |
| 5,309,586 | 5/1994 | Sies et al. . |

*Primary Examiner*—John J. Calvert
*Assistant Examiner*—Shirra L. Jenkins
*Attorney, Agent, or Firm*—Knobbe, Martens Olson & Bear

[57] ABSTRACT

An infant cover-up garment having a generally oval shape with an elastic perimeter defining an open back, an adjustable front closure with an aperture for the face of an infant, and a plurality of elastic fastener loops secured to and distributed about the elastic perimeter for enabling the garment to be releasably secured to a number of different infant carriers or stationary holding devices.

16 Claims, 1 Drawing Sheet

INFANT COVER-UP

This application is a continuation of application Ser. No. 08/611,919 filed Mar. 6, 1996, now abandoned.

BACKGROUND OF THE INVENTION

This invention relates to infant garments in general, and more particularly to covers used to protect infants and to keep infants comfortable.

Infants are frequently transported about in infant carriers, combination infant carrier/auto seats, strollers, and are also permitted to repose in stationary carriers. To protect the infant and to keep the infant comfortable, a blanket is typically used as a protective covering about the infant, typically by enveloping the infant in the blanket and tucking the blanket edges and corners under the infant in the carrier or under the carrier itself. If the blanket is too tightly arranged about the infant, the infant has little or no room to maneuver and will frequently struggle to loosen the blanket, usually successfully, so that the blanket must be rearranged again. This process can be annoying to both the infant and the adult caring for the infant.

SUMMARY OF THE INVENTION

The invention comprises an infant cover-up which is devoid of the above disadvantages, simple to manufacture and use and which provides both comfort to the infant and room to maneuver; and which is compatible with a wide variety of infant carriers and stationary infant holders.

The infant cover-up comprises a generally oval garment having an elastic perimeter defining an open back, an adjustable front closure with an aperture for the face of an infant, and a plurality of fastener loops secured to and distributed about the elastic perimeter for enabling the garment to be releasably secured to an infant carrier device. The garment is preferably fabricated from a pliable fabric, and the fabric is preferably provided with an inner fleece lining extending about the facial aperture. The adjustable front closure preferably comprises a zipper.

In use, the cover-up is secured to the infant carrier device by means of the fastener loops, and the infant is arranged within the interior of the cover-up by opening the front closure, placing the infant in the infant carrier and closing the front closure. The generally oval shape of the cover-up affords ample room for infant maneuvering of the arms and legs, while at the same time providing protection and comfort to the infant. The open back design of the cover-up with the elastic perimetral band renders the cover-up conformable with a wide variety of carrier devices, thus making the invention suitable for a wide number of uses.

For a fuller understanding of the nature and advantages of the invention, reference should be made to the ensuing detailed description, taken in conjunction with the accompanying drawings.

DETAILED DESCRIPTION OF THE PREFERRED EMBODIMENTS

Figure 1:
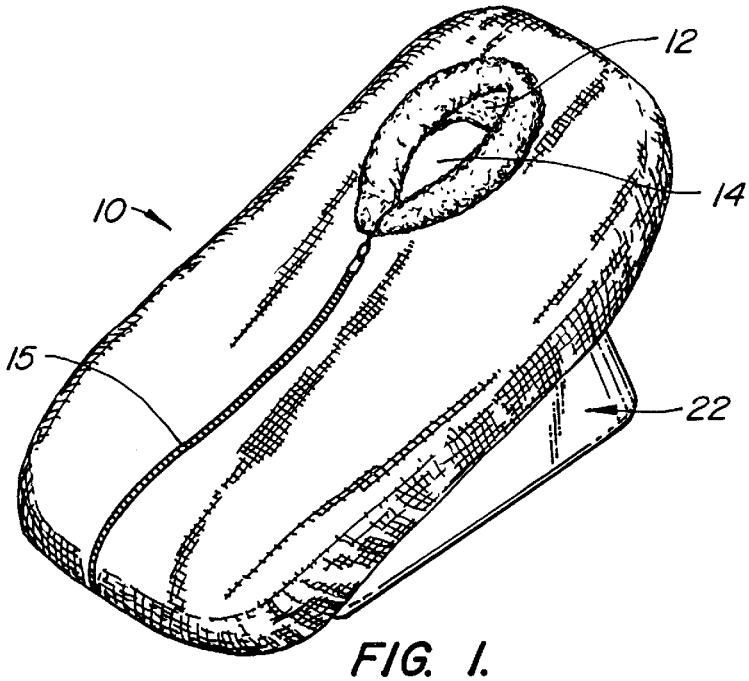
FIG. 1 is a perspective view showing the preferred embodiment of the invention in repose on a stand or carrier.
Figure 2:
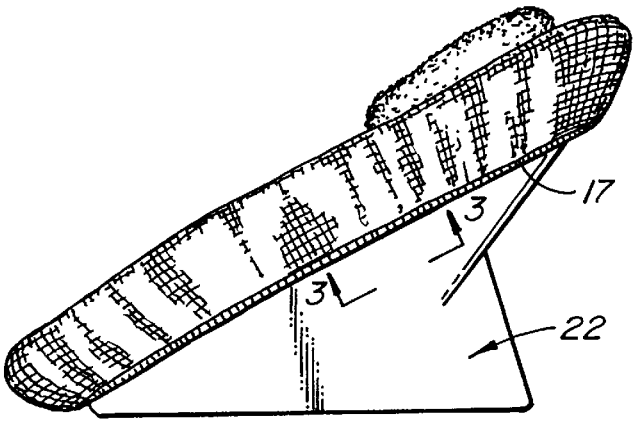
FIG. 2 is a right side elevational view of the embodiment of FIG. 1.
Figure 3:
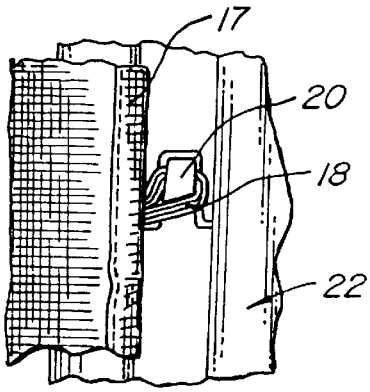
FIG. 3 is an enlarged detailed view taken in the direction of lines 3—3 of FIG. 2.
Figure 4:
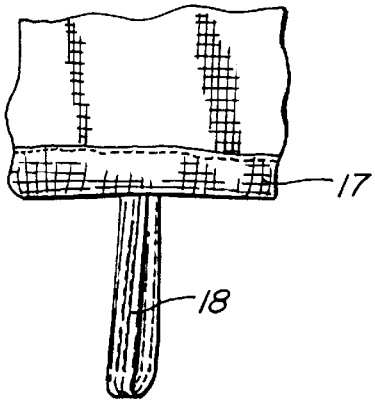
FIG. 4 is an enlarged detailed view of one of the securing loops.

Turning now to the drawings, the infant cover-up is generally designated with reference numeral 10 and is seen to comprise a covering device fabricated from a pliable fabric such as a cotton or synthetic fabric preferably provided with a fleece backing 12 for comfort and warmth. The cover-up 10 has an opening 14 for the infant's face or head and an adjustable front opening provided by a zipper 15. Around the bottom perimeter of the cover-up 10 is an elastic band 17 provided with a plurality of fastener loops 18 (see FIGS. 3 and 4) preferably fabricated from an elastic material to enable the cover-up 10 to be detachably secured to any convenient hook or protrusion 20 found on the carrier device generally designated with reference numeral 22. It is understood the carrier device 22 may comprise any one of a number of such devices, such as an infant carrier, a combination infant carrier/auto seat, a stroller or a stationary infant stand.

In use, the cover-up 10 is secured to the carrier 22 by means of the loops 18, and the infant is arranged within the interior of cover-up 10 by opening the zipper 15, placing the infant in the carrier and closing the zipper 15. The generally oval shape of the cover-up 10 affords ample room for infant maneuvering of the arms and legs, while at the same time providing protection and comfort to the infant. The open back design of the cover-up 10 with the elastic perimetral band 17 renders the cover-up 10 conformable with a wide variety of infant carriers, thus making the cover-up 10 suitable for a wide number of uses.

While the above provides a full and complete disclosure of the preferred embodiments of the invention, various modifications, alternate constructions and equivalents may be employed, as desired. Therefore, the above description and illustrations should not be construed as limiting the scope of the invention, which is defined by the appended claims.

What is claimed is:

1. An infant cover-up adapted to be removably secured to an infant carrier device, said device having a rim formed about the perimeter of the carrier device, and at least one protrusion extending from said rim, said cover-up comprising:

a fabric body having an adjustable front opening, the opening being adjustable between (i) an enlarged size at least large enough so that an infant can be placed through the front opening and into the carrier device while the cover-up is secured to the carrier device, and (ii) a reduced size small enough such that substantially all of the infant's body is covered while the infant is in the carrier device;

a closure device for adjusting the size of the front opening between the enlarged size and the reduced size;

an elastic perimeter on said fabric body defining an open back, said elastic perimeter engaging said rim to removably secure said cover-up to said carrier device; and at least one fastener loop formed separately from said fabric body and secured to said perimeter, said loop extending away from and in substantially perpendicular relationship to said elastic perimeter, said fastener loop adapted to cooperate with said protrusion to secure said cover-up to said carrier device while it is in use, whereby said cover-up is retained on said carrier device while an infant is placed through and removed from said front opening.

2. The infant cover-up of claim 1, wherein said fastener loop is elastic.

3. The infant cover-up of claim 1, wherein said elastic perimeter has a plurality of fastener loops secured about said perimeter.

4. The infant cover-up of claim 1, wherein said closure device is a zipper.

5. The infant cover-up of claim 1, wherein said fabric body has an inner fleece lining.

6. An infant cover-up adapted to be secured to an infant carrier device, said device having a rim formed about the perimeter of the carrier device, and at least one fastener along said rim, said cover-up comprising:

a fabric body;

a perimeter on said body defining an open back, said perimeter engaging said rim to secure said cover-up to said carrier device; and at least one fastener formed separately from said fabric body and extending away from and in substantially perpendicular relationship to said perimeter on said body, said fastener being adapted to cooperate with said fastener to secure said cover-up to said carrier device while it is in use.

7. The infant cover-up of claim 1, wherein said fabric body includes an adjustable front opening.

8. The infant cover-up of claim 7 additionally comprising a closure device for adjusting the size of the front opening.

9. The infant cover-up of claim 8, wherein the closure device is a zipper.

10. An infant cover-up adapted to be secured to an infant carrier device, said device having a rim formed about the perimeter of the carrier device, said cover-up comprising:

a fabric body having an adjustable front opening, the opening being adjustable between (i) an enlarged size at least large enough so that an infant can be placed through and removed from the front opening, and (ii) a reduced size small enough such that substantially all of the infant's body is covered while the infant is in the carrier device; and a closure device for adjusting the size of the front opening between the enlarged size and the reduced size, said fabric body having an elastic perimeter defining an open back, said elastic perimeter having at least one fastener formed separately from the fabric body and extending away from and in substantially perpendicular relationship to said perimeter, said elastic perimeter adapted to cooperate with said rim to secure said cover-up to said carrier device while it is in use, whereby said cover-up is retained on said carrier device while an infant is placed through and removed from said front opening.

11. An infant cover-up adapted to be secured to an infant carrier device comprising:

a fabric body having an adjustable front opening, the opening being adjustable between (i) an enlarged size at least large enough so that an infant can be placed through the front opening and into the carrier device while the cover-up is secured to the carrier device, and (ii) a reduced size small enough such that substantially all of the infant's body is covered while the infant is in the carrier device;

perimeter means for providing a bottom portion on said fabric body and for defining an open back; and at least one fastener formed separately from said fabric body and extending away from and in substantially perpendicular relationship to said perimeter for engaging said carrier device and for securing said cover-up to said carrier device while it is in use, whereby said cover-up is retained on said carrier device while an infant is placed through and removed from said front opening.

12. The infant cover-up of claim 11, additionally comprising a closure device for adjusting the size of the front opening between the enlarged size and the reduced size.

13. An infant cover-up adapted to be secured to an infant carrier device, said device having a rim formed about the perimeter of the carrier device, said cover-up comprising:

a fabric body having an adjustable front opening, the opening being adjustable between (i) an enlarged size at least large enough so that an infant can be placed through and removed from the front opening, and (ii) a reduced size small enough such that substantially all of the infant's body is covered while the infant is in the carrier device;

a perimeter on said fabric body defining an open back, said perimeter cooperating with said rim of said cover-up; and at least one fastener formed separately from said fabric body and extending away from and in substantially perpendicular relationship to said perimeter to secure said cover-up to said carrier device.

14. The infant cover-up of claim 13, wherein said fastener is an elastic loop.

15. The infant cover-up of claim 13 additionally comprising an elastic band around the perimeter of title fabric body, said elastic band being adapted to additionally secure said cover-up to said carrier device while it is in use.

16. The infant cover-up of claim 13 additionally comprising a closure device for adjusting the size if the front opening between the enlarged size and the reduced size.

* * * * *

UNITED STATES PATENT AND TRADEMARK OFFICE

CERTIFICATE OF CORRECTION

PATENT NO. : 5,956,767
DATED : September 28, 1999
INVENTOR(S) : Mary E. Imm

It is certified that error appears in the above-identified patent and that said Letters Patent is hereby corrected as shown below:

Claim 15, Column 4,
Line 45, delete "of title fabric body," and replace with --of the fabric body--.

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*